United States Patent [19]

Syrovatka

[11] 3,964,761

[45] June 22, 1976

[54] SKI BOOT HEEL ATTACHMENT DEVICE

[76] Inventor: George Eugen Syrovatka, 4998 Maisonneuve St., Montreal, Quebec, Canada

[22] Filed: Aug. 28, 1975

[21] Appl. No.: 608,634

[52] U.S. Cl. ..... 280/623
[51] Int. Cl.[2] ..... A63C 9/08
[58] Field of Search ..... 280/11.35 H, 11.35 R

[56] References Cited

UNITED STATES PATENTS 2,438,623 3/1948 Stanimir ..... 280/11.35 H

FOREIGN PATENTS OR APPLICATIONS 65,020 7/1942 Norway ..... 280/11.35 H 330,858 7/1956 Switzerland ..... 280/11.35 H

*Primary Examiner*—Robert R. Song

[57] ABSTRACT

A ski boot heel attachment device comprising a base plate attachable to a ski and adapted for sliding retention of a clamp member. The clamp member has a clamp head and an elongated slide section rearwardly thereof for displaceable sliding engagement with the base plate. A lever is provided and has a pivot connection to an end of the slide section opposite the clamp head. A pivotal link connection is secured between the lever and the base plate to provide longitudinal sliding displacement of the clamp member relative to the base plate by arcuate displacement of the lever about the pivot connection.

10 Claims, 4 Drawing Figures

SKI BOOT HEEL ATTACHMENT DEVICE

BACKGROUND OF THE INVENTION a. Field of the Invention

The present invention relates to ski bindings, and more particularly, to a heel attachment device for clamping the heel of a ski boot on a ski.

b. Description of Prior Art

More particularly, but not exclusively, the present invention relates to a ski boot heel attachment device for clamping the heel of a ski boot on cross-country type skis.

Ski bindings for cross-country type skis consist essentially of a toe binding for retaining the toe of a ski boot on a ski and at the same time permitting free upward movement of the heel of the ski boot above the face of the ski. Thus, the cross-country skier is provided with the heel flexibility required for such type skiing. However, when the cross-country skier is required to ski downhill or to herringbone up a hill, such toe bindings do not provide the proper rigid attachment of the ski boot to the ski which is necessary for the skier to effect such manouevers under control. Accordingly, with the front toe binding, a certain danger presents itself when the skier is required to go down or up a hill or when effecting any other type manouevers where it is desirable to have rigid attachment of the ski boot to the ski. With the toe binding, there is too much side movement or wobbly movement of the ski boot.

SUMMARY OF INVENTION

It is an object of the present invention to provide a ski boot heel attachment device which substantially overcomes all the above-mentioned disadvantages.

It is a further feature of the present invention to provide a ski boot heel attachment device which is easily engageable and disengageable from the heel of a ski boot.

It is a still further feature of the present invention to provide a ski boot heel attachment device for use on cross-country type skis.

It is a still further feature of the present invention to provide a ski boot heel attachment device which is substantially economical to make, and easy to install and repair.

According to the above features, from a broad aspect, the present invention provides a ski boot heel attachment device comprising a base plate attachable to a ski and adapted for sliding retention of a clamp member. The clamp member has a clamp head and an elongated slide section rearwardly thereof for displaceable sliding engagement with the base plate. A lever is provided and has a pivot connection to an end of the slide section opposite the clamp head. A pivotal link connection is secured between the lever and the base plate to provide longitudinal sliding displacement of the clamp member relative to the base plate by arcuate displacement of the lever about the pivot connection.

BRIEF DESCRIPTION OF DRAWINGS

A preferred embodiment of the present invention will now be described with reference to the structures illustrated by the accompanying drawings in which.

DESCRIPTION OF PREFERRED EMBODIMENTS

Figure 1:
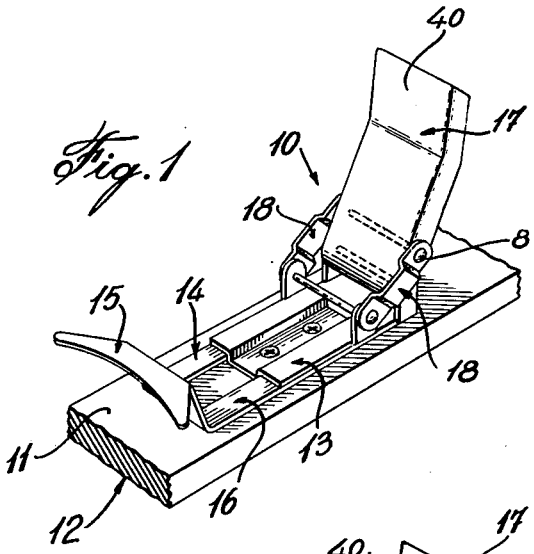
FIG. 1 is a perspective view of a version of the ski boot heel attachment device of the present invention.
Figure 2:
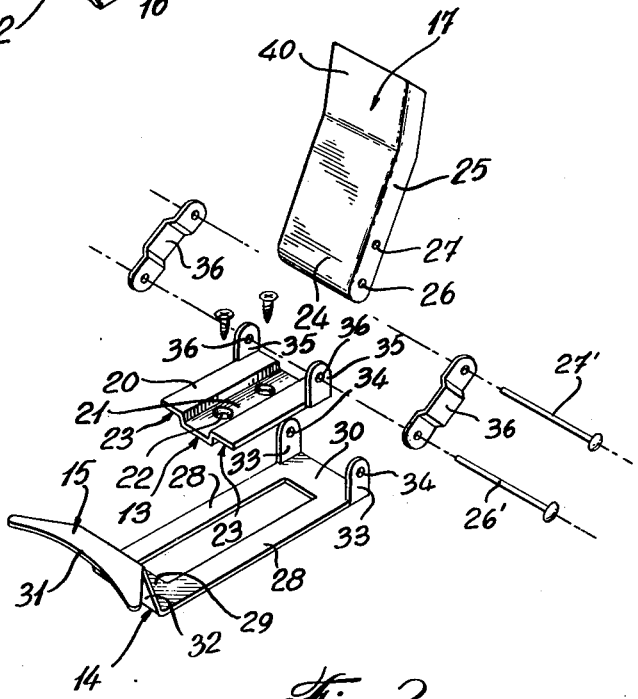
FIG. 2 is an exploded part view of the ski boot heel attachment device of FIG. 1.
Figure 3:
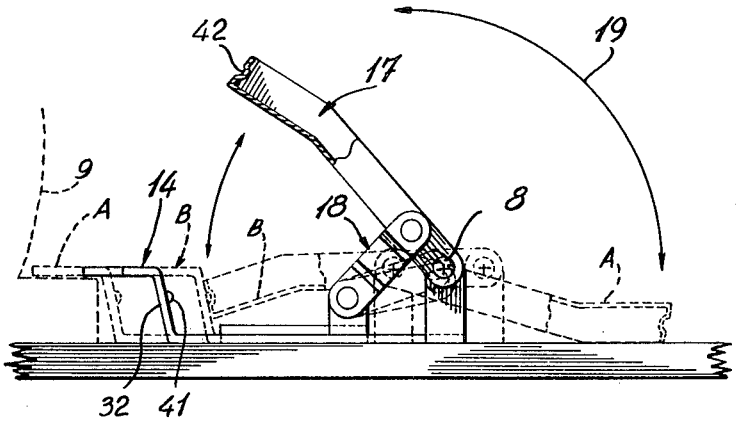
FIG. 3 is a side view showing the ski boot heel attachment device in its operative and inoperative positions.

The present invention will now be described with reference to a first embodiment as illustrated by FIGS. 1 to 3. As shown in FIG. 1, the ski boot heel attachment device 10 is secured to the top face 11 of a ski 12, herein a narrow cross-country type ski. Generally, the device 10 comprises a base plate 13 for slidingly retaining a clamp member 14 on the top face 11 of the ski 12. The clamp member 14 is provided with a clamp head 15 and an elongated slide section 16, rearwardly of the clamp head 15. for displaceable sliding engagement with the base plate 13. A lever 17 is pivotally connected by pivotal connection 8 at an end of the slide section 16 opposite the clamp head 15. A pivotal link connection 18 is secured between the lever 17 and the base plate 13 to provide longitudinal sliding displacement of the clamp member 14 relative to the base plate 13. This longitudinal sliding displacement is effected by arcuate displacement of the lever 17 about the pivot connection 8 as more clearly shown in FIG. 3. Thus, by moving the lever 17 in an arcuate manner represented by the arrow 19 in FIG. 3, the clamp head 15 and, of course, the entire clamp member 14 will move in and out of engagement with the heel of a ski boot 9 position forwardly thereof.

Referring now more specifically to FIG. 2, there is shown the basic parts constituting the ski boot heel attachment device 10. As hereinshown, the base plate 13 is of substantially U-shape cross-section having outwardly extending flat wings 20 and an attachment bottom wall 21 provided with holes 22 therein for attaching the base plate to the upper face 11 of the ski 12. The wings 20 provide an open-ended channel between its underface and the top face of a ski for slidingly receiving a portion of the elongated slide section 16 of the clamp member 14. The open-ended channels are designated by numeral 23.

The lever 17 is provided with a flat wall 24 and parallel side arms 25 extending above a respective face thereof. A pair of aligned pivot connecting holes 26 are provided in each side wall 25 adjacent a lower end of the lever 17. A further pair of aligned pivot connecting holes 27 are provided uppermost from the pivot connection holes 26 for receiving a pin 27' for pivotal connection with the link connection 18.

The elongated slide section 16 of the clamp member 14 consists of parallel spaced flat side arms 28 each for sliding engagement within a respective one of the channels 23 defined by the base plate 13. Integral front and rear bridge members 29 and 30 are integrally formed and extend across a respective one of opposed ends of the parallel spaced side arms 28. The clamp head 15 is formed by a clamp plate defining a concave front edge 31 elevated from the parallel side arms 28 by an angulated upwardly extending section 32 formed integral with the front bridge member 29.

The rear bridge member 30 is provided with a pivot connection attachment member, hereinshown as a pair of ears 33, extending above the parallel side arms 28. A hole 34 is provided in each ear 33 and in alignment with the hole of the other ear for pivotally securing the lower end of the lever 17 therebetween by a pivot pin 26′ to provide a pivotal connection with the lower end of the lever 17.

The base plate 13 is further provided with opposed aligned link attachment arms 35 each of which is also provided with a hole 36 therein. A pair of link arms 37, each provided with a hole at each end thereof, is secured at one end to a respective one of the link attachment arms 35 and at the other end thereof to a respective one of the pivotal connecting holes 27 on the lever 17. These link arms 37 constitute the aforementioned link connection 18.

The upper end or free end 40 of the lever 17 is engageable whereby to actuate the clamp member by displacement of the lever along the arc 19 as shown in FIG. 3 from an engageable position shown at A to a disengageable position shown at B. As shown in FIG. 3, the lever is arcuately displaced about the pivot connection 18 through an arc of at least 180°. By this displacement and with the device dimensions shown, the clamp member 14 is displaceable within the range of between one-half to two inches. This range will give sufficient clearance between the clamping head and heel of the boot when the clamp is disengaged. A small ridge or knob 41 may be provided on the section 32 of the clamp member 14 for frictionally engaging with a groove 42 in the free end 43 of the lever 17. This prevents the lever from displacement when the device is in the inoperative position B and there is no locking pressure on the lever. When the lever 17 is in the engaging position A, the link connection 18 maintains the lever biased against the top face 11 of the ski 12 toward its free end 40. Although the members of the device 10 hereinshown are made of metal, other suitable materials, such as plastics, can be utilized, provided the intended object of the invention is obtainable. It is also within the ambit of the invention to provide a clamping member having a slide section which is a single rod-like element for sliding engagement within a single open-ended channel provided in a base plate. Still further, the base plate can be constructed to be displaceably adjustable with the upper surface of a ski or a further element secured thereto, whereby the clamp will engage within a range of boot sizes. That is to say, the base plate can be adjusted within a predetermined range.

Figure 4:
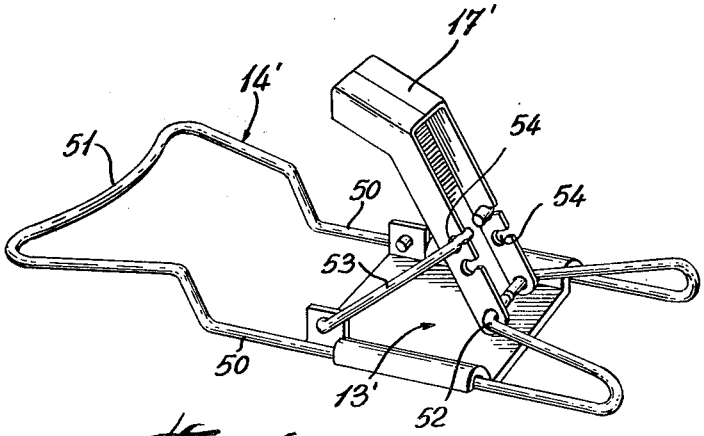
FIG. 4 is a perspective view of a further version of ski boot heel attachment device of the present invention.

Referring now to FIG. 4, there is shown a further embodiment of the present invention. As hereinshown, the clamp member 14′ is constituted by a formed rigid wire-like member defining parallel spaced side arms 50, a clamp head 51 at a front end of the clamp member 14′, and elevated from the side arms 50. The front end of the clamp head is slightly of concave curvature whereby to conform to the rear portion of a ski boot to better engage in the area above the heel of a boot. As shown, the side arms 50 are upwardly turned at a rear end thereof to define a pivotal connection at 52 for pivotally securing a lower end of the lever 17′ thereto. The pivot connection 18 as hereinabove mentioned relative to the embodiment shown in FIG. 1, is herein provided by the link wire arms 53 pivotally connected at each end between the base plate 13′ and clamp member 14′. In this embodiment, there is clearly shown two pivotal connecting points constituted by grooves 54 and spaced uppermost from the pivotally secured lowered end of the lever whereby to provide a variable adjustment range of the clamp member 14′. Hereinshown, the base plate 13′ is substantially of the construction as shown in FIG. 1 with the difference being that it is secured in a substantially inverse manner. Also, it can be seen that the clamp head 51 extends at a downward angle relative to the plane of the side arms 50 whereby to provide slight downward pressure on the heel of a ski boot.

The operation of both of the ski boot heel attachment devices hereinabove described are basically the same in that when the lever is displaced through the arc 19 from a forward to a rearward position, the clamp member will move from a rearward to a forward position, i.e., from its disengaged position to its engaged position. This is achieved in that as the lever is swung backwards, the link 36 or 53 will cause the pivoted lower end of the clamp member 14 to move forwardly toward the clamp head causing the clamp head 15 to move forwardly.

I claim:

1. A ski boot heel attachment device comprising a base plate attachable to a ski and adapted for sliding retention of a clamp member, said clamp member having a clamp head and an elongated slide section rearwardly thereof for displaceable sliding engagement with said base plate, a lever having a pivot connection to an end of said slide section opposite said clamp head, and a pivotal link connection secured between said lever and said base plate to provide longitudinal sliding displacement of said clamp member relative to said base plate by arcuate displacement of said lever about said pivot connection.

2. An attachment device as claimed in claim 1, wherein said base plate is provided with an open-ended channel for slidingly receiving a portion of said elongated slide section therethrough.

3. An attachment device as claimed in claim 1, wherein said lever is arcuately displaced about said pivot connection through an arc of at least 180°.

4. An attachment device as claimed in claim 1, wherein said clamp head of said clamp member is displaced within the range of between one-half to two inches by said arcuate displacement of said lever.

5. An attachment device as claimed in claim 1, wherein said base plate is provided with a pair of parallel open-ended channels, said elongated slide section having parallel spaced side arms each for sliding engagement within a respective one of said channels.

6. An attachment device as claimed in claim 5, wherein integral transverse front and rear bridge members are provided across a respective one of the opposed ends of said parallel spaced side arms, said clamp head being a clamp plate having a concave front edge elevated from said parallel side arms by an angulated section integral with said transverse front bridge member.

7. An attachment device as claimed in claim 6, wherein said transverse rear bridge member is provided with a pivot connection attachment member for pivotally securing a lower end of said lever thereto to provide said pivot connection.

8. An attachment device as claimed in claim 7, wherein said base plate is provided with opposed aligned link attachment arms, said pivotal link connection being two link arms each pivotally secured at one end to a respective one of said link attachment arms and at another end to a respective one of aligned pivotal connecting points on said lever uppermost from said pivotally secured lower end, said lever having an engageable free end opposite said secured lower end.

9. An attachment device as claimed in claim 1, wherein said clamp member is a formed rigid wire-like member defining parallel spaced side arms, a clamp head at a front end of said clamp member and elevated from said side arms, said side arms being upwardly turned at a rear end thereof to define a pivotal connection for pivotally securing a lower end of said lever thereto to provide said pivot connection.

10. An attachment device as claimed in claim 9, wherein said pivotal link connection is securable to one or more pivotal connecting points on said lever uppermost from said pivotally secured lower end whereby to provide a variable adjustment range of said displaceable engagement between said clamp member and said base plate.

* * * * *